US006539193B1

(12) United States Patent
Aoki et al.

(10) Patent No.: US 6,539,193 B1
(45) Date of Patent: Mar. 25, 2003

(54) DEVELOPING APPARATUS AND IMAGE FORMING APPARATUS FOR STABLY FORMING A DEVELOPER LAYER ON A DEVELOPER DEVICE

(75) Inventors: Shinji Aoki, Tokyo (JP); Takao Izumi, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/934,607

(22) Filed: Aug. 23, 2001

(51) Int. Cl.[7] ..... G03G 15/08
(52) U.S. Cl. ..... 399/281; 399/284
(58) Field of Search ..... 399/281, 284

(56) References Cited

U.S. PATENT DOCUMENTS 4,836,135 A * 6/1989 Kohyama et al. ..... 399/281
4,866,480 A * 9/1989 Hosoya et al. ..... 399/281

FOREIGN PATENT DOCUMENTS

JP 10-228169 8/1998

* cited by examiner

*Primary Examiner*—William J. Royer
(74) *Attorney, Agent, or Firm*—Foley & Lardner

(57) ABSTRACT

A developing apparatus of this invention includes a developing roller composed of an inelastic body, for feeding toner to an electrostatic latent image and developing the electrostatic latent image, and a layer thickness regulation blade composed of an inelastic body, for abutting on the developing roller and regulating a thickness of a layer of the toner fed to the electrostatic latent image to a certain extent. The developing apparatus has the following relation:

$$R1 \sin(\mathrm{Cos}^{-1}((R1-r1)/R1)) < X1 < R1 \sin(\mathrm{Cos}^{-1}((R1-3r1)/R1))$$

where a volume average grain size of the toner is represented by r1, a radius of the developing roller is represented by R1, and a distance from an abutment portion of the layer thickness regulation blade and the developing roller to a free end of the layer thickness regulation blade is represented by X1.

16 Claims, 2 Drawing Sheets

DEVELOPING APPARATUS AND IMAGE FORMING APPARATUS FOR STABLY FORMING A DEVELOPER LAYER ON A DEVELOPER DEVICE

BACKGROUND OF THE INVENTION

This invention relates to a developing apparatus and image forming apparatus built in, for example, a copier, a printer and the like employing electrophotography.

A developing apparatus of this type comprises a developing roller. A layer thickness regulation blade abuts on the developing roller in a plane or an edge portion of a free end of a layer thickness regulation blade linearly abuts on the developing roller to provide electric charge to a toner and regulate a thickness of a toner layer to a constant extent.

In the above-mentioned developing apparatus, an inelastic or elastic layer thickness regulation blade abuts on an elastic or inelastic developing roller to regulate the thickness of the toner layer.

In a conventional developing apparatus, however, there are problems as explained below.

In a case where the layer thickness regulation blade abuts on the developing roller in a plane, the thickness of the toner layer formed on the developing roller is greatly varied in accordance with a distance from an abutment portion (i.e. a nip portion) to the free end of the layer thickness regulation blade.

That is, a toner retention portion is generated at a part from the nip portion to the free end of the layer thickness regulation blade. For this reason, the toner of the toner retention portion may be excessively pushed between the developing roller and the layer thickness regulation blade by a conveying force of the developing roller and the toner may spill over.

The spillage of toner can be prevented by enhancing the pressurizing force of the layer thickness regulation blade to the developing roller.

In this case, however, much frictional heat is generated at the nip portion and toner fixation occurs at the layer thickness regulation blade. Further, as an agglomerate such as toner, dust and the like is retained at the toner retention portion, stripes and the like are generated on the toner layer on the developing roller by the fixing toner and the agglomerate and, image quality is thereby deteriorated.

On the other hand, in the developing apparatus where the free end of the layer thickness regulation blade abuts on the developing roller, as it is difficult to adjust an abutting force of the layer thickness regulation blade on the developing roller and it is very difficult to uniformly maintain the nip along the longitudinal direction of the developing roller, a uniform toner layer cannot be formed stably and a preferable output image cannot be obtained.

BRIEF SUMMARY OF THE INVENTION

This invention is accomplished in consideration of the above circumstances, and the object of this invention is to provide a developing apparatus and image forming apparatus capable of stably forming a developer layer having a predetermined thickness on a developing device, preventing a developer from spilling over from a layer thickness regulation device, and preventing stripes from being generated on the developer layer by developer fixation or foreign matters.

A developing apparatus of this invention comprises a developing device composed of an inelastic body, for feeding a developer to a portion to be developed and developing the portion, and a layer thickness regulation device composed of an inelastic body, for abutting on the developing device and regulating a thickness of the developer fed to the developed portion to a certain extent. This developing apparatus has the following relation:

$$R1\ \sin(\mathrm{Cos}^{-1}((R1-r1)/R1))<X1<R1\ \sin(\mathrm{Cos}^{-1}((R1-3r1)/R1))$$

where a volume average grain size of the developer is represented by r1, a radius of the developing device is represented by R1, and a distance from an abutment portion of the layer thickness regulation device and the developing device to a free end of the layer thickness regulation device is represented by X1.

A developing apparatus of this invention comprises a developing device for feeding a developer to a portion to be developed and developing the portion, and a layer thickness regulation device for abutting on the developing device and regulating a thickness of the developer fed to the developed portion to a certain extent. One of the developing device and the layer thickness regulation device is composed of an inelastic body and the other is composed of an elastic body, and this developing apparatus has the following relation:

$$R1\ \sin(\mathrm{Cos}^{-1}((R1-r1)/R1))<X2-Z/2<R1\ \sin(\mathrm{Cos}^{-1}((R1-3r1)/R1))$$

where a volume average grain size of the developer is represented by r1, a radius of the developing device is represented by R1, a width of an abutment portion of the layer thickness regulation device and the developing device is represented by Z, and a distance from a center of the abutment portion to a free end of the layer thickness regulation device is represented by X2.

An image forming apparatus of this invention comprises an image carrier for carrying an electrostatic latent image, a developing device composed of an inelastic body, for feeding a developer to the electrostatic latent image on the image carrier and developing the electrostatic latent image, a layer thickness regulation device composed of an inelastic body, for abutting on the developing device and regulating a thickness of the developer fed to the electrostatic latent image to a certain extent, and a transfer device for transferring a developer image developed on the image carrier to a member to be transferred. This image forming apparatus has the following relation:

$$R1\ \sin(\mathrm{Cos}^{-1}((R1-r1)/R1))<X1<R1\ \sin(\mathrm{Cos}^{-1}((R1-3r1)/R1))$$

where a volume average grain size of the developer is represented by r1, a radius of the developing device is represented by R1, and a distance from an abutment portion of the layer thickness regulation device and the developing device to a free end of the layer thickness regulation device is represented by X1.

An image forming apparatus of this invention comprises an image carrier for carrying an electrostatic latent image, a developing device for feeding a developer to the electrostatic latent image on the image carrier and developing the electrostatic latent image, a layer thickness regulation device for abutting on the developing device and regulating a thickness of the developer fed to the electrostatic latent image to a certain extent, and a transfer device for transferring a developer image developed on the image carrier to a member to be transferred. One of the developing device and the layer thickness regulation device is composed of an inelastic body and the other is composed of an elastic body, and this developing apparatus has the following relation:

$$R1\ \sin(\mathrm{Cos}^{-1}((R1-r1)/R1))<X2-Z/2<R1\ \sin(\mathrm{Cos}^{-1}((R1-3r1)/R1))$$

where a volume average grain size of the developer is represented by r1, a radius of the developing device is represented by R1, a width of an abutment portion of the layer thickness regulation device and the developing device is represented by Z, and a distance from a center of the abutment portion to a free end of the layer thickness regulation device is represented by X2.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of this invention will be explained in detail with reference to the drawings.

Figure 1:
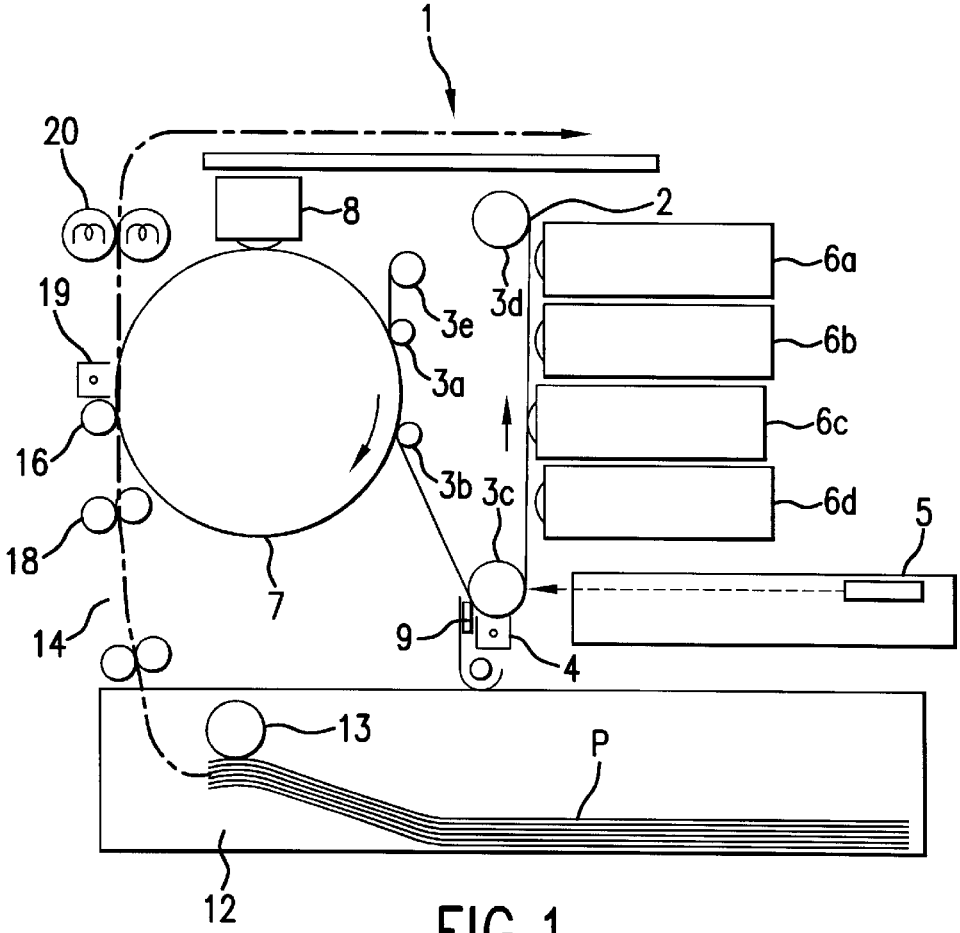
FIG. 1 shows a diagram of a color electrophotographic copying apparatus according to an embodiment of this invention.

FIG. 1 shows a diagram of a color electrophotographic apparatus serving as an image forming apparatus according to an embodiment of this invention.

The color electrophotographic apparatus comprises an image formation unit 1. The image formation unit 1 comprises a photosensitive belt 2 serving as an image carrier. The photosensitive belt 2 is looped over a plurality of first to fifth rollers 3*a* to 3*e* with a predetermined tensile strength to run in a direction of an arrow.

An electrifying unit 4 for electrifying the photosensitive belt 2 at a predetermined electric potential, an exposure unit 5 for forming an electrostatic latent image on the electrified photosensitive belt 2, and first to fourth developing units 6*a* to 6*d* for feeding toner to the electrostatic latent image formed on the photosensitive belt 2 to visualize the electrostatic latent image, are arranged around the photosensitive belt 2, in the running direction thereof. Moreover, a freely rotatable middle transfer unit 7 for temporarily holding the visualized electrostatic latent image (toner image) on the electrified photosensitive belt 2 and a cleaning unit 9 for removing toner remaining on the electrified photosensitive belt 2 are also arranged around the photosensitive belt 2, in the running direction thereof. A cleaner 8 for cleaning the middle transfer unit 7 is provided on an upper side of the middle transfer unit 7.

A part of the photosensitive belt 2 looped between the first roller 3*a* and the second roller 3*b* is in close contact with an outer peripheral surface of the middle transfer unit 7, and a part of the photosensitive belt 2 looped between the third roller 3*c* and the fourth roller 3*d* is remote from the developing units 6*a* to 6*d* in a constant distance.

A drive motor (not shown) is connected to any one of the first to fifth rollers 3*a* to 3*e*, and the first to fifth rollers 3*a* to 3*e* are driven to rotate at a predetermined speed in a direction of an arrow by the rotation of the drive motor.

A paper cassette 12 for containing paper P as a transferred member of a predetermined size is provided below the image formation unit 1. A paper feed roller 13 for taking sheets of paper P one by one from the paper cassette 12 is provided at the paper cassette 12.

A conveyance system 14 for conveying the paper P to the middle transfer unit 7 is provided between the paper cassette 12 and the middle transfer unit 7. A transfer roller 16 serving as a transfer device is provided in a state of being opposite to the middle transfer unit 7, in the conveyance system 14, to transfer the toner image formed on the middle transfer unit 7 onto the paper P.

Aligning rollers 18 are provided on an upstream side in the paper conveying direction of the transfer roller 16. The aligning rollers 18 temporarily stop the paper P conveyed by the conveyance system 14, correct inclination of the paper P to the conveying direction and make a leading end of the paper P match a leading end of the toner image on the middle transfer unit 7.

A peeling unit 19 for applying AC charge to peel off the paper P on which the toner image is transferred from the middle transfer unit 7, and a fixing unit 20 for fixing the toner image transferred on the paper P, are arranged on a downstream side in the paper conveying direction of the transfer roller 16.

Next, a full-color printing operation of the above-described color electrophotographic apparatus will be explained.

The surface of the photosensitive belt 2 rotated by rollers is uniformly electrified to a predetermined potential. Subsequently, the photosensitive belt 2 is subjected to exposure corresponding to an yellow image by the exposure unit 5 to form an electrostatic latent image. Yellow toner is supplied from an yellow developing unit 6*a* and the electrostatic latent image formed on the photosensitive belt 2 is thereby developed to form a yellow toner image. The yellow toner image is further transferred onto the middle transfer unit 7. After this transfer, the photosensitive belt 2 is peeled from the middle transfer unit 7 and optically destaticized by a destaticizer (not shown). The toner which is not transferred to the middle transfer unit 7 and left on the photosensitive belt 2 is cleaned by the cleaning unit 9. The cleaned toner is reclaimed by a waste toner box (not shown).

After that, the photosensitive belt 2 is electrified again by the electrifying unit 4 and subjected to exposure corresponding to a magenta image by the exposure unit 5, and an electrostatic latent image is thereby formed. The electrostatic latent image formed on the photosensitive belt 2 is developed with magenta toner by a magenta developing unit 6*b*, and a magenta toner image is superimposed and transferred on the yellow toner image on the middle transfer unit 7. A cyan toner image and a black toner image are processed in the same steps and, thus, a four-color-superimposed toner image is formed on the middle transfer unit 7.

After the image formation, the paper P is fed between the middle transfer unit 7 and the transfer roller 16, such that the four-color-superimposed toner image is secondarily transferred onto the paper P. The paper having the four-color toner image is peeled from the middle transfer unit 7 by the peeling unit 19 and conveyed to the fixing unit 20, and a color image of the fixed toner is thereby obtained.

As the toner which is not transferred onto the paper P remains on the middle transfer unit 7, the cleaner 8 contacts and cleans the middle transfer unit 7 after the secondary transfer has been finished.

The cleaner 8 is remote from the middle transfer unit 7 while the above-mentioned four-color-superimposed toner image is formed on the middle transfer unit 7.

Figure 2:
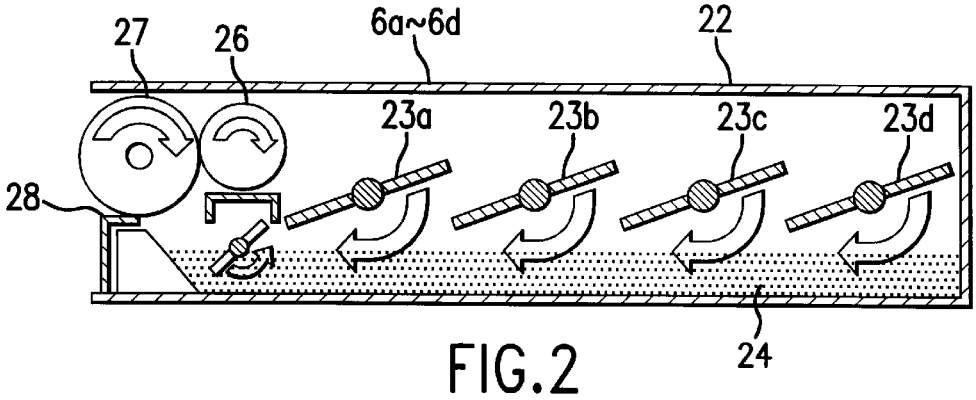
FIG. 2 shows a diagram of an internal structure of a developing apparatus built in the copying apparatus of FIG. 1.

FIG. 2 shows a structure of the developing units 6*a* to 6*d* of non-magnetic single component.

Each of the developing units 6*a* to 6*d* comprises a developing casing 22 for containing non-magnetic single-component toner 24 as a developer. Plural (four) carrier vanes 23*a* to 23*d* for carrying the toner are arranged inside the developing casing 22. A feed roller 26 and a developing roller 27, which serves as a developing device, are arranged in front of the carrier vane 23*a*. A layer thickness regulation blade 28 serving as a layer thickness regulation device for regulating the thickness of the toner layer on the developing roller 27 to a certain extent is provided under the developing roller 27.

The carrier vanes 23*a* to 23*d* are rotated, and the toner is carried and fed to the feed roller 26 by this rotation, at the development. This toner is fed to the developing roller 27 by the rotation of the feed roller 26. The toner fed to the developing roller 27 is regulated by the layer thickness regulation blade 28, such that the pressure of the layer thereof becomes constant. After the regulation of the thickness of the toner layer, the toner is fed to the electrostatic latent image on the photosensitive belt 2 and the electrostatic latent image becomes visualized.

Figure 3:
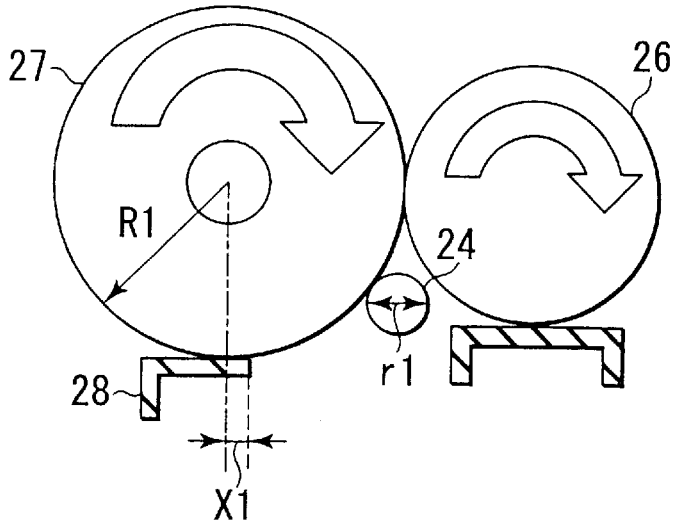
FIG. 3 shows an enlarged view of a part of the developing apparatus.

FIG. 3 shows an enlarged view of an attachment portion of the developing roller 27 and layer thickness regulation blade 28 in the developing apparatus according to the invention.

The developing roller 27 is composed of an A1 sleeve having a surface roughness Rz ranging from 2 to 3. The layer thickness regulation blade 28 is an SUS-made leaf spring having a thickness of 0.1 mm, which is made to abut on the developing roller 27 with a pressurizing force of 60 N/m. Foamed polyurethane is used as the feed roller 26.

A distance from the abutment portion of the layer thickness regulation blade 28 and the developing roller 27 to the free end of the layer thickness regulation blade 28 is represented by X1.

TABLE 1

| Distance | Radius of developing roller $R_1$ = 9 mm<br>Average grain size of toner $r_1$ [× $10^{-3}$ mm] | |
|---|---|---|
| $x_1$ [mm] | 8 | 10 |
| 0.0 | X (Layer formation failed) | X (Layer formation failed) |
| 0.1 | X (Layer formation failed) | X (Layer formation failed) |
| 0.2 | X (Layer formation failed) | X (Layer formation failed) |
| 0.3 | Δ (Layer formation partially failed) | X (Layer formation failed) |
| 0.4 | ○ | Δ (Layer formation partially failed) |
| 0.5 | ○ | ○ |
| 0.6 | ○ | ○ |

TABLE 1-continued

| Distance | Radius of developing roller $R_1$ = 9 mm<br>Average grain size of toner $r_1$ [× $10^{-3}$ mm] | |
|---|---|---|
| $x_1$ [mm] | 8 | 10 |
| 0.7 | Δ (Toner partially spilt) | ○ |
| 0.8 | X (Toner spilt) | Δ(Toner partially spilt) |
| 0.9 | X (Toner spilt) | X (Toner spilt) |
| 1.0 | X (Toner spilt) | X (Toner spilt) |

*Range of ○ is: $R_1 \sin(\mathrm{Cos}^{-1}((R_1-r_1)/R_1)) < x_1 < R_1 \sin(\mathrm{Cos}^{-1}((R_1-3r_1)/R_1))$

TABLE 2

| Distance | Radius of developing roller $R_1$ = 11 mm<br>Average grain size of toner $r_1$ [× $10^{-3}$ mm] | |
|---|---|---|
| $x_1$ [mm] | 8 | 10 |
| 0.0 | X (Layer formation failed) | X (Layer formation failed) |
| 0.1 | X (Layer formation failed) | X (Layer formation failed) |
| 0.2 | X (Layer formation failed) | X (Layer formation failed) |
| 0.3 | X (Layer formation failed) | X (Layer formation failed) |
| 0.4 | Δ (Layer formation partially failed) | Δ (Layer formation partially failed) |
| 0.5 | ○ | ○ |
| 0.6 | ○ | ○ |
| 0.7 | ○ | ○ |
| 0.8 | Δ (Toner partially spilt) | ○ |
| 0.9 | X (Toner spilt) | Δ (Toner partially spilt) |
| 1.0 | X (Toner spilt) | X (Toner spilt) |

*Range of ○ is: $R_1 \sin(\mathrm{Cos}^{-1}((R_1-r_1)/R_1)) < x_1 < R_1 \sin(\mathrm{Cos}^{-1}((R_1-3r_1)/R_1))$ TABLE 1 shows a relationship between the distance X1 from the abutment portion of the layer thickness regulation blade 28 and the developing roller 27 to the free end of the layer thickness regulation blade 28, and a forming condition of the toner layer, in a case where the developing roller having a radius of 9 mm is employed with two kinds of toner having different average grain sizes of 8 mm and 10 mm.

TABLE 2 shows a relationship between the distance X1 from the abutment portion of the layer thickness regulation blade 28 and the developing roller 27 to the free end of the layer thickness regulation blade 28, and a forming condition of the toner layer, in a case where the developing roller having a radius of 11 mm is employed with two kinds of toner having different average grain sizes of 8 mm and 10 mm.

Formation of a very stable toner layer can be implemented, obviously, when the distance X1 is expressed by the following relational expression $$R1 \sin(\mathrm{Cos}^{-1}((R1-r1)/R1)) < X1 < R1 \sin(\mathrm{Cos}^{-1}((R1-3r1)/R1))$$

where r1 represents a volume average grain size of the toner 24 and R1 represents the radius of the developing roller 27.

Although a developing roller 27 is continuously driven for 60 min. at the peripheral speed of 250 mm/s, toner fixation does not occur, or image failure caused by agglomerates, foreign matters and the like in the toner intruding between the developing roller 27 and the layer thickness regulation blade 28, does not occur.

Figure 4:
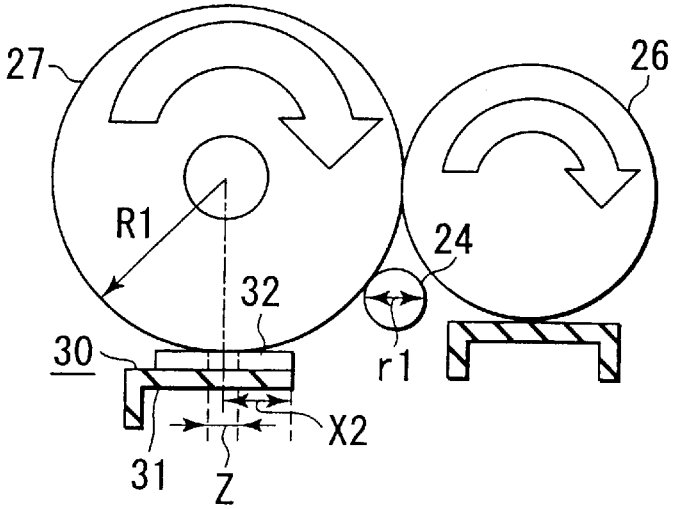
FIG. 4 shows a view of the developing apparatus according to a second embodiment of this invention.

FIG. 4 shows a second embodiment of this invention.

The same portions as those of the first embodiment are denoted by the same reference numerals and their explanations are omitted.

The non-magnetic single-component toner 24 is fed to the developing roller 27 by the feed roller 26. The thickness of the toner 24 fed to the developing roller 27 is regulated to be a certain thickness by a layer thickness regulation blade 30.

The developing roller 27 is composed of an A1 sleeve having a surface roughness Rz ranging from 2 to 3. The layer thickness regulation blade 30 is composed of an SUS-made leaf spring 31 having a thickness of 0.1 mm and a urethane chip 32 having a thickness of 1 mm and being attached onto the leaf spring 31. The urethane chip 32 of the layer thickness regulation blade 30 is made to abut on the developing roller 27 with a pressurizing force of 60 N/m.

A width Z of the nip portion between the developing roller 27 and the urethane chip 32 is obtained by observing profile of a frictional deterioration part generated by rotation of the developing roller 27, with a laser microscope (made by Laser Tec: Scanning Microscope). A region where the value of 10-point average roughness Rz calculated by accessory software is the same as a value of parts other than the friction portion within a range of measurement of 0.1 mm and a part between the ends thereof is regarded as the nip portion.

Figure 5:
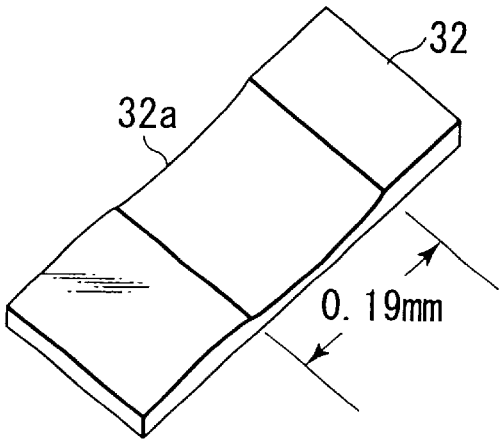
FIG. 5 shows a perspective view of a urethane chip attached to a layer thickness regulation blade in the developing apparatus of FIG. 4.

FIG. 5 shows a three-dimensional image obtained by observing a friction portion 32*a* of the urethane chip 32 with the laser microscope.

TABLE 3

(Nip width 0.19 mm)
Radius of developing roller R = 9 mm

| Distance | Average grain size of toner $r_1$ [$\times 10^{-3}$ mm] | |
|---|---|---|
| $x_2$ [mm] | 8 | 10 |
| 0.0 | X (Layer formation failed) | X (Layer formation failed) |
| 0.1 | X (Layer formation failed) | X (Layer formation failed) |
| 0.2 | X (Layer formation failed) | X (Layer formation failed) |
| 0.3 | X (Layer formation failed) | X (Layer formation failed) |
| 0.4 | Δ (Layer formation partially failed) | X (Layer formation failed) |
| 0.5 | ○ | Δ (Layer formation partially failed) |
| 0.6 | ○ | ○ |
| 0.7 | ○ | ○ |
| 0.8 | Δ (Toner partially spilt) | Δ (Toner partially spilt) |
| 0.9 | X (Toner spilt) | X (Toner spilt) |
| 1.0 | X (Toner spilt) | X (Toner spilt) |

*Range of ○ is: $R_1 \sin(\mathrm{Cos}^{-1}((R_1-r_1)/R_1)) < x_2-z/2 < R_1 \sin(\mathrm{Cos}^{-1}((R_1-3r_1)/R_1))$

TABLE 4

(Nip width 0.19 mm)
Radius of developing roller $R_1$ = 11 mm

| Distance | Average grain size of toner $r_1$ [$\times 10^{-3}$ mm] | |
|---|---|---|
| $x_1$ [mm] | 8 | 10 |
| 0.0 | X (Layer formation failed) | X (Layer formation failed) |
| 0.1 | X (Layer formation failed) | X (Layer formation failed) |
| 0.2 | X (Layer formation failed) | X (Layer formation failed) |
| 0.3 | X (Layer formation failed) | X (Layer formation failed) |
| 0.4 | X (Layer formation failed) | X (Layer formation failed) |
| 0.5 | Δ (Layer formation partially failed) | Δ (Layer formation partially failed) |
| 0.6 | ○ | ○ |
| 0.7 | ○ | ○ |
| 0.8 | ○ | ○ |
| 0.9 | Δ (Toner partially spilt) | ○ |
| 1.0 | X (Toner spilt) | Δ (Toner partially spilt) |

*Range of ○ is: $R_1 \sin(\mathrm{Cos}^{-1}((R_1-r_1)/R_1)) < x_2-z/2 < R_1 \sin(\mathrm{Cos}^{-1}((R_1-3r_1)/R_1))$ TABLE 3 shows a relationship between a distance X2 from the abutment portion of the layer thickness regulation blade 30 and the developing roller 27 to the free end of the layer thickness regulation blade 30, and a forming condition of the toner layer, in a case where the developing roller having a radius R1 of 9 mm is employed with two kinds of toner 24 having different average grain sizes r1 of 8 mm and 10 mm.

TABLE 4 shows a relationship between the distance X2 from the abutment portion of the layer thickness regulation blade 30 and the developing roller 27 to the free end of the layer thickness regulation blade 30, and a forming condition of the toner layer, in a case where the developing roller having a radius R1 of 11 mm is employed with two kinds of toner having different average grain sizes r1 of 8 mm and 10 mm.

As clarified from TABLE 3 and TABLE 4, formation of a very stable toner layer can be implemented when the distance X2 is expressed by the following relational expression $$R1 \sin(\mathrm{Cos}^{-1}((R1-r1)/R1)) < X2-Z/2 < R1 \sin(\mathrm{Cos}^{-1}((R1-3r1)/R1))$$

Even if the developing roller 27 is composed of an elastic body and the layer thickness regulation blade 30 is composed of an inelastic material, the same relational expression as the above one is concluded.

As described above, when the developing apparatus of this invention, if both the developing roller 27 and the layer thickness regulation blade 28 are inelastic bodies, and when there is the following relationship:

$$R1 \sin(\mathrm{Cos}^{-1}((R1-r1)/R1)) < X1 < R1 \sin(\mathrm{Cos}^{-1}((R1-3r1)/R1))$$

where the volume average grain size of the toner 24 is r1, the radius of the developing roller 27 is R1, and the distance from the abutment portion of the layer thickness regulation blade 28 and the developing roller 27 to the free end of the layer thickness regulation blade 28 is X1, failure of layer formation in the layer thickness regulation blade 28 or toner spill does not occur or generation of stripes on the toner layer due to the toner fixation and foreign matters can be prevented.

In addition, when the developing roller is an inelastic body and the layer thickness regulation member is an elastic body, and when there is the following relationship:

$$R1 \sin(\mathrm{Cos}^{-1}((R1-r1)/R1)) < X2-Z/2 < R1 \sin(\mathrm{Cos}^{-1}((R1-3r1)/R1))$$

where the volume average grain size of the toner is r1, the radius of the developing roller is R1, the nip width of the abutment portion between the layer thickness regulation member and the developing roller is Z, and the distance from the center of the nip portion to the free end of the layer thickness regulation member is X2, failure of layer formation in the layer thickness regulation member or toner spill does not occur or generation of stripes on the toner layer due to the toner fixation and foreign matters can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing apparatus comprising:

a developing device composed of an inelastic body, for feeding a developer to a portion to be developed and developing the portion; and a layer thickness regulation device composed of an inelastic body, for abutting on the developing device and regulating a thickness of the developer fed to the developed portion to a certain extent;

wherein said developing apparatus has the following relation $$R1\ \sin(\mathrm{Cos}^{-1}((R1-r1)/R1))<X1<R1\ \sin(\mathrm{Cos}^{-1}((R1-3r1)/R1))$$

where a volume average grain size of the developer is represented by r1, a radius of the developing device is represented by R1, and a distance from an abutment portion of the layer thickness regulation device and the developing device to a free end of the layer thickness regulation device is represented by X1.

2. A developing apparatus according to claim 1, wherein the developing device and the layer thickness regulation device are of metal.

3. A developing apparatus according to claim 1, wherein the developer is non-magnetic single-component toner.

4. A developing apparatus comprising:

a developing device for feeding a developer to a portion to be developed and developing the portion; and a layer thickness regulation device for abutting on the developing device and regulating a thickness of the developer fed to the developed portion to a certain extent;

wherein one of the developing device and the layer thickness regulation device is composed of an inelastic body and the other is composed of an elastic body; and wherein said developing apparatus has the following relation $$R1\ \sin(\mathrm{Cos}^{-1}((R1-r1)/R1))<X2-Z/2<R1\ \sin(\mathrm{Cos}^{-1}((R1-3r1)/R1))$$

where a volume average grain size of the developer is represented by r1, a radius of the developing device is represented by R1, a width of an abutment portion of the layer thickness regulation device and the developing device is represented by Z, and a distance from a center of the abutment portion to a free end of the layer thickness regulation device is represented by X2.

5. A developing apparatus according to claim 4, wherein the developer is non-magnetic single-component toner.

6. A developing apparatus according to claim 5, wherein the developing device is composed of an inelastic body and the layer thickness regulation device is composed of an elastic body.

7. A developing apparatus according to claim 5, wherein the developing device is of metal and the layer thickness regulation device is composed of a polymeric material.

8. A developing apparatus according to claim 7, wherein the layer thickness regulation device is of polyurethane.

9. An image forming apparatus comprising:

an image carrier for carrying an electrostatic latent image;

a developing device composed of an inelastic body, for feeding a developer to the electrostatic latent image on the image carrier and developing the electrostatic latent image;

a layer thickness regulation device composed of an inelastic body, for abutting on the developing device and regulating a thickness of the developer fed to the electrostatic latent image to a certain extent; and a transfer device for transferring a developer image developed on the image carrier to a member to be transferred;

wherein said forming apparatus has the following relation $$R1\ \sin(\mathrm{Cos}^{-1}((R1-r1)/R1))<X1<R1\ \sin(\mathrm{Cos}^{-1}((R1-3r1)/R1))$$

where a volume average grain size of the developer is represented by r1, a radius of the developing device is represented by R1, and a distance from an abutment portion of the layer thickness regulation device and the developing device to a free end of the layer thickness regulation device is represented by X1.

10. An image forming apparatus according to claim 9, wherein the developing device and the layer thickness regulation device are of metal.

11. An image forming apparatus according to claim 9, wherein the developer is non-magnetic single-component toner.

12. An image forming apparatus comprising:

an image carrier for carrying an electrostatic latent image;

a developing device for feeding a developer to the electrostatic latent image on the image carrier and developing the electrostatic latent image;

a layer thickness regulation device for abutting on the developing device and regulating a thickness of the developer fed to the electrostatic latent image to a certain extent; and a transfer device for transferring a developer image developed on the image carrier to a member to be transferred;

wherein one of the developing device and the layer thickness regulation device is composed of an inelastic body and the other is composed of an elastic body; and wherein said image forming apparatus has the following relation $$R1\ \sin(\mathrm{Cos}^{-1}((R1-r1)/R1))<X2-Z/2<R1\ \sin(\mathrm{Cos}^{-1}((R1-3r1)/R1))$$

where a volume average grain size of the developer is represented by r1, a radius of the developing device is represented by R1, a width of an abutment portion of the layer thickness regulation device is represented by Z, and a distance from a center of the abutment portion to a free end of the layer thickness regulation device is represented by X2.

13. An image forming apparatus according to claim 12, wherein the developer is non-magnetic single-component toner.

14. An image forming apparatus according to claim 12, wherein the developing device is composed of an inelastic body and the layer thickness regulation device is composed of an elastic body.

15. An image forming apparatus according to claim 14, wherein the developing device is of metal and the layer thickness regulation device is composed of a polymeric material.

16. An image forming apparatus according to claim 15, wherein the layer thickness regulation device is of polyurethane.

* * * * *